US009200508B2

(12) United States Patent
Duncan et al.

(10) Patent No.: US 9,200,508 B2
(45) Date of Patent: Dec. 1, 2015

(54) METHOD AND APPARATUS FOR MONITORING VIBRATION USING FIBER OPTIC SENSORS

(75) Inventors: Roger G. Duncan, Christiansburg, VA (US); Brooks A. Childers, Christiansburg, VA (US); Robert M. Harman, Troutville, VA (US); Ajit Balagopal, Christiansburg, VA (US)

(73) Assignee: Baker Hughes Incorporated, Houston, TX (US)

( * ) Notice: Subject to any disclaimer, the term of this patent is extended or adjusted under 35 U.S.C. 154(b) by 377 days.

(21) Appl. No.: 12/985,773

(22) Filed: Jan. 6, 2011

(65) Prior Publication Data

US 2012/0179378 A1 Jul. 12, 2012

(51) Int. Cl.

| | |
|---|---|
| ***G01V 3/38*** | (2006.01) |
| ***E21B 47/00*** | (2012.01) |
| ***E21B 47/12*** | (2012.01) |

(52) U.S. Cl.

CPC ..... *E21B 47/0007* (2013.01); *E21B 47/123* (2013.01)

(58) Field of Classification Search

CPC ..... E21B 47/123; E21B 47/0007
USPC ..... 702/8
See application file for complete search history.

(56) References Cited

U.S. PATENT DOCUMENTS

| | | | | |
|---|---|---|---|---|
| 4,902,888 | A | 2/1990 | Kondo | |
| 5,881,310 | A * | 3/1999 | Airhart et al. | 710/3 |
| 6,289,143 | B1 | 9/2001 | Berthold et al. | |
| 7,028,543 | B2 | 4/2006 | Hardage et al. | |
| 7,040,390 | B2 | 5/2006 | Tubel et al. | |
| 7,113,659 | B2 | 9/2006 | Taverner | |
| 7,548,319 | B2 * | 6/2009 | Hartog | 356/478 |

(Continued)

FOREIGN PATENT DOCUMENTS

| | | |
|---|---|---|
| JP | 4355323 | 12/1992 |
| JP | 6063726 B2 | 8/1994 |
| JP | 2002116103 A | 4/2002 |

OTHER PUBLICATIONS

Notification of Transmittal of the International Search Report and the Written Opinion of the International Searching Authority, or the Declaration; PCT/US2011/029649; Jul. 30, 2012.

(Continued)

*Primary Examiner* — Sujoy Kundu
*Assistant Examiner* — Ricky Ngon
(74) *Attorney, Agent, or Firm* — Cantor Colburn LLP

(57) ABSTRACT

A apparatus for monitoring a downhole component is disclosed. The apparatus includes: an optical fiber sensor including a plurality of sensing locations distributed along a length of the optical fiber sensor; an interrogation assembly configured to transmit an electromagnetic interrogation signal into the optical fiber sensor and receive reflected signals from each of the plurality of sensing locations; and a processing unit configured to receive the reflected signals, select a measurement location along the optical fiber sensor, select a first reflected signal associated with a first sensing location in the optical fiber sensor, the first sensing location corresponding with the measurement location, select a second reflected signal associated with a second sensing location in the optical fiber sensor, estimate a phase difference between the first signal and the second signal, and estimate a parameter of the downhole component at the measurement location based on the phase difference.

20 Claims, 4 Drawing Sheets

(56) References Cited

U.S. PATENT DOCUMENTS

| | | | | |
|---|---|---|---|---|
| 7,636,166 | B2 * | 12/2009 | De Groot et al. | 356/500 |
| 7,668,411 | B2 | 2/2010 | Davies et al. | |
| 7,740,064 | B2 | 6/2010 | McCoy et al. | |
| 7,772,541 | B2 * | 8/2010 | Froggatt et al. | 250/227.23 |
| 8,452,557 | B2 * | 5/2013 | Naumann et al. | 702/65 |
| 2009/0114386 | A1 | 5/2009 | Hartog et al. | |
| 2010/0014071 | A1 | 1/2010 | Hartog | |
| 2010/0038079 | A1 | 2/2010 | Greenaway | |
| 2010/0219334 | A1 * | 9/2010 | Legrand et al. | 250/256 |
| 2011/0090496 | A1 * | 4/2011 | Samson et al. | 356/301 |
| 2012/0230629 | A1 * | 9/2012 | Hill et al. | 385/12 |

OTHER PUBLICATIONS

Conforti, et al. "Fiber Optic Vibration Sensor for Remort Monitoring in High Power Electric Machines". Applied Optics. vol. 28, No. 23, Dec. 1, 1989. pp. 5158-5161.

Mark Froggatt and Jason Moore, "High-Spatial-Resolution Distributed Strain Measurement in Optical Fiber with Rayleigh Scatter," Appl. Opt. 37, 1735-1740 (1998). [Abstract Only].

M. Froggatt, B. Soller, D. Gifford, and M. Wolfe, "Correlation and keying of Rayleigh scatter for loss and temperature sensing in parallel optical networks," in Optical Fiber Communication Conference, Technical Digest (CD) (Optical Society of America, 2004), paper PD17. [Abstract Only].

S. T. Kreger, D. K. Gifford, M. E. Froggatt, B. J. Soller, and M. S. Wolfe, "High Resolution Distributed Strain or Temperature Measurements in Single- and Multi-Mode Fiber Using Swept-Wavelength Interferometry," in Optical Fiber Sensors, OSA Technical Digest (CD) (Optical Society of America, 2006), paper ThE42.

B. J. Soller, M. Wolfe, and M. E. Froggatt, "Polarization Resolved Measurement of Rayleigh Backscatter in Fiber-Optic Components," in Optical Fiber Communication Conference and Exposition and The National Fiber Optic Engineers Conference, Technical Digest (CD) (Optical Society of America, 2005).

* cited by examiner

METHOD AND APPARATUS FOR MONITORING VIBRATION USING FIBER OPTIC SENSORS

BACKGROUND

Fiber-optic sensors have been utilized in a number of applications, and have been shown to have particular utility in sensing parameters in harsh environments.

Different types of motors are utilized in downhole environments in a variety of systems, such as in drilling, pumping and production operations. For example, electrical submersible pump systems (ESPs) are utilized in hydrocarbon exploration to assist in the removal of hydrocarbon-containing fluid from a formation and/or reservoir. ESP and other systems are disposed downhole in a wellbore, and are consequently exposed to harsh conditions and operating parameters that can have a significant effect on system performance and useful life of the systems. ESP and other systems vibrate for multiple reasons, in addition to normal motor vibration. Excessive motor vibration can occur for various reasons, and should be addressed to avoid damage and/or failure of the motor and other downhole components. Motors and generators, in themselves not easy to monitor, present particular challenges when they are located in harsh environments.

SUMMARY

An apparatus for monitoring a downhole component includes: an optical fiber sensor having a length thereof in an operable relationship with the downhole component and configured to deform in response to deformation of the downhole component, the optical fiber sensor including a plurality of sensing locations distributed along a length of the optical fiber sensor; an interrogation assembly configured to transmit an electromagnetic interrogation signal into the optical fiber sensor and receive reflected signals from each of the plurality of sensing locations; and a processing unit configured to receive the reflected signals, select a measurement location along the optical fiber sensor, select a first reflected signal associated with a first sensing location in the optical fiber sensor, the first sensing location corresponding with the measurement location, select a second reflected signal associated with a second sensing location in the optical fiber sensor, estimate a phase difference between the first signal and the second signal, and estimate a parameter of the downhole component at the measurement location based on the phase difference.

A method of monitoring a downhole component includes: disposing a length of an optical fiber sensor in a fixed relationship relative to a downhole component, the optical fiber sensor configured to deform in response to deformation of the downhole component, the optical fiber sensor including a plurality of sensing locations distributed along a length of the optical fiber sensor; transmitting an electromagnetic interrogation signal into the optical fiber sensor and receiving reflected signals from each of the plurality of sensing locations; selecting a measurement location along the optical fiber sensor; selecting a first reflected signal associated with a first sensing location in the optical fiber sensor, the first sensing location corresponding with the measurement location; selecting a second reflected signal associated with a second sensing location in the optical fiber sensor; estimating by a processor a phase difference between the first signal and the second signal; and estimating a parameter of the downhole component at the measurement location based on the phase difference.

BRIEF DESCRIPTION OF THE DRAWINGS

Referring now to the drawings, wherein like elements are numbered alike in the several Figures.

DETAILED DESCRIPTION OF EXEMPLARY EMBODIMENTS

Apparatuses, systems and methods for monitoring downhole components are provided. Such apparatuses and systems are used, in one embodiment, to estimate vibrations and changes in vibration in components such as motors and generators. In one embodiment, a monitoring system includes a reflectometer having a processing unit and an optical fiber sensor. The optical fiber sensor includes an optical fiber sensor having a plurality of sensing locations disposed therein, such as locations configured to intrinsically scatter transmitted electromagnetic signals. The optical fiber sensor may be dedicated for monitoring the downhole component or may be incorporated with other fiber optic components, such as communication and sensing fibers. An embodiment of a method of monitoring a downhole component includes receiving reflected signals from the plurality of sensing locations, and estimating a phase difference between a first and second sensing location in the optical fiber sensor. In one embodiment, the method includes estimating phase differences between sensing locations associated with a plurality of measurement locations (each of which may correspond to a location on or in the downhole component) and generating a distributed, time-varying phase difference pattern that can be used to estimate and monitor vibration or other parameters of the downhole component.

Figure 1:
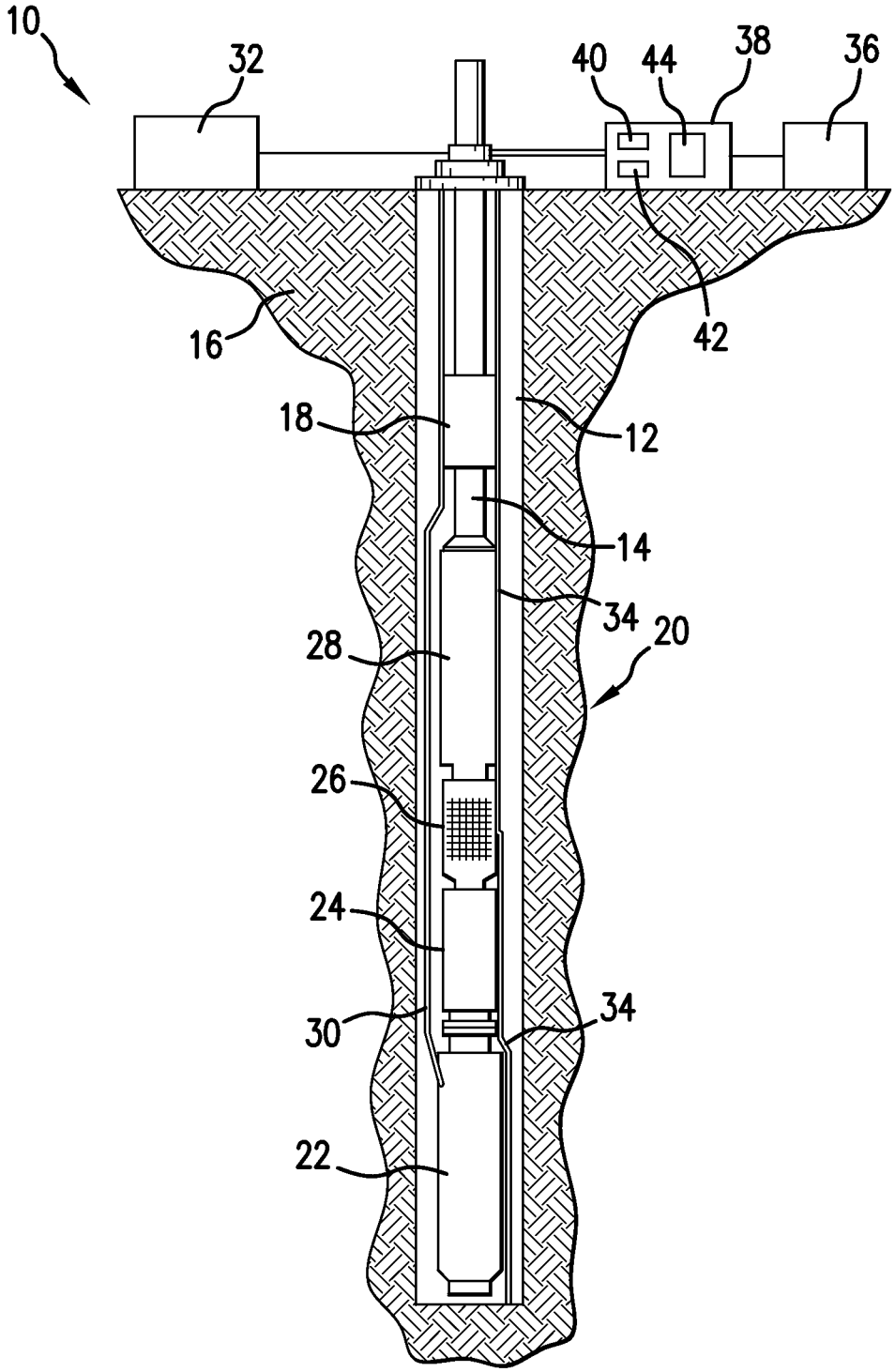
FIG. 1 is a cross-sectional view of an embodiment of a downhole drilling, monitoring, evaluation, exploration and/or production system.

Referring to FIG. 1, an exemplary embodiment of a downhole drilling, monitoring, evaluation, exploration and/or production system 10 associated with a wellbore 12 is shown. A borehole string 14 is disposed in the wellbore 12, which penetrates at least one earth formation 16 for facilitating operations such as drilling, extracting matter from the formation and making measurements of properties of the formation 16 and/or the wellbore 12 downhole. The borehole string 14 includes any of various components to facilitate subterranean operations. The borehole string 14 is made from, for example, a pipe, multiple pipe sections or flexible tubing. The borehole string 14 includes for example, a drilling system and/or a bottomhole assembly (BHA).

The system 10 and/or the borehole string 14 include any number of downhole tools 18 for various processes including drilling, hydrocarbon production, and formation evaluation (FE) for measuring one or more physical quantities in or around a borehole. For example, the tools 18 include a drilling assembly and/or a pumping assembly. Various measurement tools may be incorporated into the system 10 to affect measurement regimes such as wireline measurement applications or logging-while-drilling (LWD) applications.

In one embodiment, at least one of the tools 18 includes an electrical submersible pump (ESP) assembly 20 connected to the production string 14 as part of, for example, a bottomhole assembly (BHA). The ESP assembly 20 is utilized to pump production fluid through the production string 14 to the surface. The ESP assembly 20 includes components such as a motor 22, a seal section 24, an inlet or intake 26 and a pump 28. The motor 22 drives the pump 28, which takes in fluid (typically an oil/water mixture) via the inlet 26, and discharges the fluid at increased pressure into the production string 14. The motor 22, in one embodiment, is supplied with electrical power via an electrical conductor such as a downhole power cable 30, which is operably connected to a power supply system 32.

The tools 18 and other downhole components are not limited to those described herein. In one embodiment, the tool 18 includes any type of tool or component that experiences vibration, deformation or stress downhole. Examples of tools that experience vibration include motors or generators such as ESP motors, other pump motors and drilling motors, as well as devices and systems that include or otherwise utilize such motors.

The system 10 also includes one or more fiber optic components 34 configured to perform various functions in the system 10, such as communication and sensing various parameters. For example, fiber optic components 34 may be included as a fiber optic communication cable for transmitting data and commands between downhole components and/or between downhole components and a surface component such as a surface processing unit 36. Other examples of fiber optic components 34 include fiber optic sensors configured to measure downhole properties such as temperature, pressure, downhole fluid composition, stress, strain and deformation of downhole components such as the borehole string 14 and the tools 18. The optical fiber component 34, in one embodiment, is configured as an optical fiber sensor and includes at least one optical fiber having one or more sensing locations disposed along the length of the optical fiber sensor 34. Examples of sensing locations include fiber Bragg gratings (FBG), mirrors, Fabry-Perot cavities and locations of intrinsic scattering. Locations of intrinsic scattering include points in or lengths of the fiber that reflect interrogation signals, such as Rayleigh scattering, Brillouin scattering and Raman scattering locations.

The system 10 also includes an optical fiber monitoring system configured to interrogate one or more of the optical fiber components 34 to estimate a parameter (e.g., vibration) of the tool 18, ESP assembly 20 or other downhole component. In one embodiment, the monitoring system in configured to identify a change in a parameter such as vibration. A change in vibration may indicate that the downhole component has broken or otherwise been damaged, and the monitoring system can enable rapid diagnosis of problems so that remedial actions can be taken. In one embodiment, at least a portion of the optical fiber component 34 is integrated with or affixed to a component of the tool 18, such as the ESP motor 22 or other motor or generator. For example, the fiber optical component 34 is attached to a housing or other part of the motor 22, the pump 28 or other component of the ESP assembly 20.

The optical fiber monitoring system may be configured as a distinct system or incorporated into other fiber optic systems. For example, the monitoring system may incorporate existing optical fiber components such as communication fibers and temperature or strain sensing fibers. Examples of monitoring systems include Extrinsic Fabry-Perot Interferometric (EFPI systems), optical frequency domain reflectometry (OFDR) and optical time domain reflectometry (OTDR) systems.

The monitoring system includes a reflectometer configured to transmit an electromagnetic interrogation signal into the optical fiber component 34 and receive a reflected signal from one or more locations in the optical fiber component 34. An example of a reflectometer unit 38 is illustrated in FIG. 1. The reflectometer unit 38 is operably connected to one or more optical fiber components 34 and includes a signal source 40 (e.g., a pulsed light source, LED, laser, etc.) and a signal detector 42. In one embodiment, a processor 44 is in operable communication with the signal source 40 and the detector 42 and is configured to control the source 40 and receive reflected signal data from the detector 42. The reflectometer unit 38 includes, for example, an OFDR and/or OTDR type interrogator to sample the ESP assembly 20 and/or tool 18.

Figure 2:
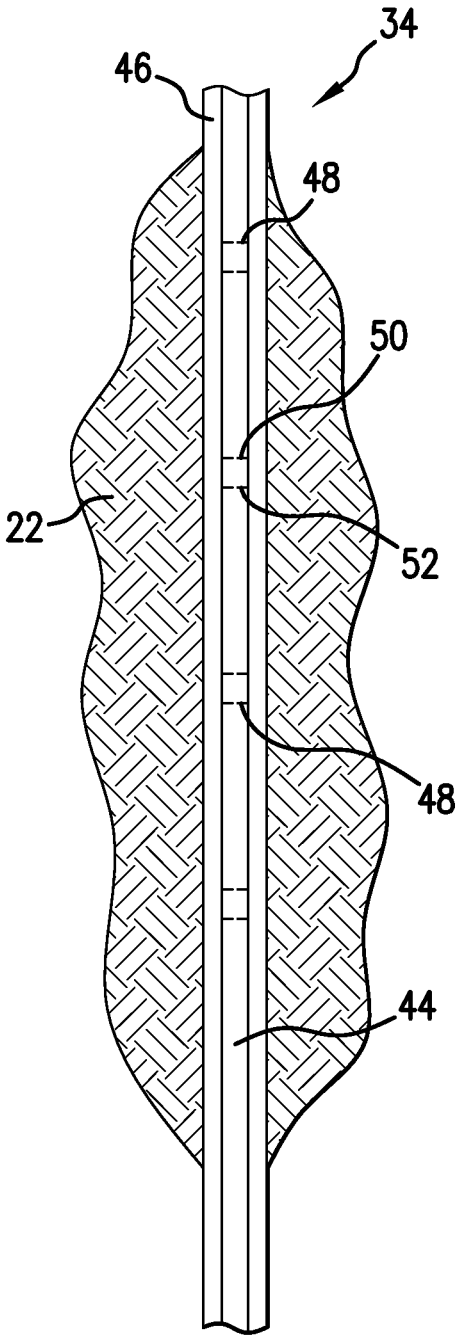
FIG. 2 is a cross-sectional view of a portion of an optical fiber sensor of the system of FIG. 1.

Referring to FIG. 2, the optical fiber component 34 includes at least one optical fiber 44. The optical fiber component 34 and/or optical fiber 44 may be dedicated for use as a monitoring device for a downhole component, or may be also configured for other uses as, for example, a communication or measurement device. For example, the optical fiber 44 is a communication fiber or a pressure/temperature sensor, and is utilized additionally as a vibration monitor as described herein. In one embodiment, the optical fiber 44 is affixed to the motor 22 (or other component) or otherwise disposed in a fixed position relative to the motor 22 so that vibrations or other motion or deformation of the motor 22 is transferred to the optical fiber 44. For example, the optical fiber component 34 is adhered to the motor 22, is disposed in a groove or conduit in the motor housing, or is attached via brackets or other mechanisms. In one embodiment, the optical fiber component 34 includes a protective sleeve 46 such as a cable jacket or metal tube that is configured to protect the fiber 44 from downhole conditions and/or relieve strain on the fiber 44.

As shown in FIG. 2, the optical fiber component 34 is disposed axially along the motor 22. The optical fiber component 34 is not limited to this configuration. For example, the optical fiber component 34 may be wrapped around a component, e.g., shaped into a helix that spirals around a portion of the ESP assembly and/or tool 18.

The optical fiber 44 includes one or more reflective sensing locations 48 disposed within the optical fiber 44 (e.g., in the fiber core). The sensing locations 48 include reflectors disposed along a length of the fiber 44 that return a reflected signal in response to an interrogation signal transmitted into the fiber 44 by, for example, the reflectometer unit 38. Changes in the optical fiber 44 result in changes in the reflected signals. For example, vibration or other movement or deformation induces changes in the effective length of the optical fiber 44, which in turn changes the reflected signals. For example, vibration and/or deformation of the fiber 44 at selected locations or distributed along a length of the fiber 44 can be estimated by estimating phase changes in reflected signals. Examples of sensing locations 48 include reflectors such as Fabry-Perot cavities, mirrors, partially reflecting mirrors, Bragg gratings and any other configurations that induce reflections which could facilitate parameter measurements.

In one embodiment, the reflectometer unit 38 is configured to detect signals reflected due to the native or intrinsic scattering produced by an optical fiber. Examples of such intrinsic scattering include Rayleigh, Brillouin and Raman scattering. The interrogator unit 38 is configured to correlated received reflected signals with locations along a length of the optical fiber 44. For example, the interrogator unit 38 is configured to record the times of reflected signals and associate the arrival time of each reflected signal with a location or region disposed along the length of the optical fiber 44. These reflected signals can be modeled as a weakly reflecting fiber Bragg gratings, and can be used similarly to such gratings to estimate various parameters of the optical fiber 44 and associated components. In this way, desired locations along the fiber 44 can be selected and do not depend on the location of pre-installed reflectors such as Bragg gratings and fiber end-faces.

In one embodiment, the reflectometer unit 38 is configured as an interferometer. The reflectometer unit 38 receives reflected signals from a plurality of sensing locations 48, and is configured to compare data from one or more pairs of reflected signals, each of which is generated by a primary sensing location and a reference sensing location. In one embodiment, the interferometer is formed from the sensing locations 48 disposed in the optical fiber 44. For example, reflected signals from a pair of native scattering locations (e.g., a first scattering location 50 and a second scattering location 52) can be analyzed to estimate a phase shift between the reflected signals from the scattering locations 50, 52, and estimate the associated deformation or movement. Examples of such locations are shown in FIG. 2, but are not limited as shown. In one embodiment, sensing locations 48 such as Rayleigh scattering locations are distributed at least substantially continuously along the fiber 44, and can be selected from any desired position along the length of the fiber. Interrogating these locations continuously or periodically over time may be used to generate time-varying data indicative of vibration of components such as the tool 18 or ESP 20.

In one embodiment, a reference optical path is established along the borehole 12 by an additional reference optical fiber disposed within or external to the tool 18 or ESP 20. As a result, the reference optical fiber forms a reference path and the optical fiber 44 forms a measurement path. The reflectometer unit 38 receives the reflected signals from each path and correlates the locations based on the time in which each signal is received. A phase difference between sensing locations in the measurement path and the reference path having the same position (e.g., depth) may be calculated, and the change in the phase difference over time may then be used to estimate the vibration (or other motion or deformation) of an associated downhole component. In one embodiment, the measurement path and the reference path are configured to form a Mach-Zehnder interferometer.

Figure 3:
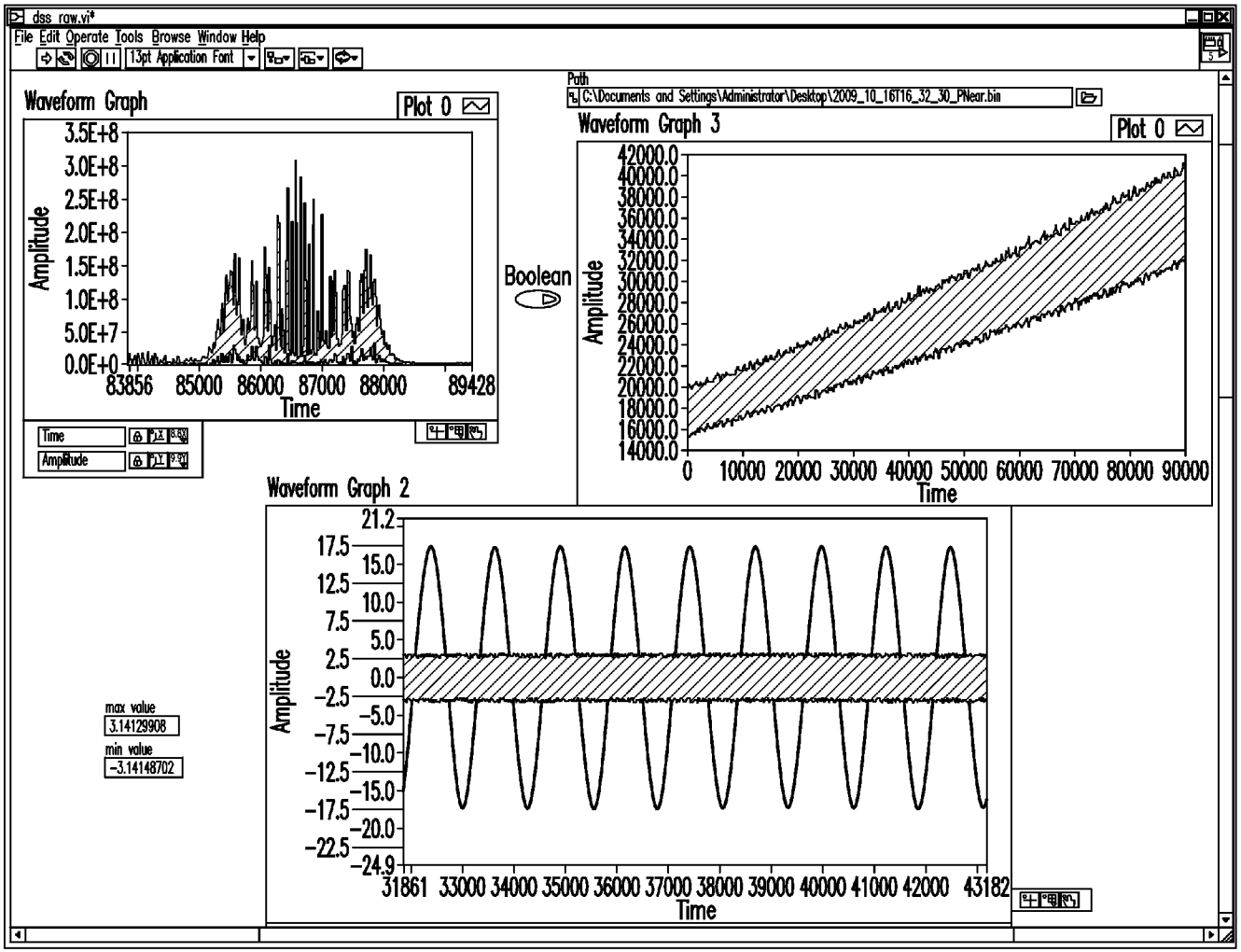
FIG. 3 is an illustration of interferometric signal data indicating vibrational or oscillatory motion.

FIG. 3 is an illustration of signal data shown as signal wavelength over time, which provides an indication of vibrational or oscillatory motion. This exemplary data was generated using an interrogator that utilizes swept-wavelength interferometry to interrogate two air-gap reflectors, with a piezo-based fiber stretcher in-between the reflectors. The fiber stretcher was driven by with a simple sine function of modest frequency. The swept-wavelength source of the interrogator was swept over a spectral range of about 3 nm at a sweep rate of approximately 10 nm/s, while data was collected with a wavelength synchronous data acquisition approach. The resulting data was processed by performing an fast Fourier transform (FFT), windowing the peak resulting from reflected signals from the two reflectors interfering with one another, performing an inverse transform, unwrapping the phase data resulting from that process, fitting a line to the unwrapped phase, and subtracting a line. The residual is the sine wave shown in FIG. 3 and represents the time-varying signal resulting from the vibration of the fiber stretcher.

The monitoring system, optical fiber components 34, tools 18, ESP 20 and motors are not limited to the embodiments described herein, and may be disposed with any suitable carrier. A "carrier" as described herein means any device, device component, combination of devices, media and/or member that may be used to convey, house, support or otherwise facilitate the use of another device, device component, combination of devices, media and/or member. Exemplary non-limiting carriers include drill strings of the coiled tube type, of the jointed pipe type and any combination or portion thereof. Other carrier examples include casing pipes, wirelines, wireline sondes, slickline sondes, drop shots, downhole subs, bottom-hole assemblies, and drill strings.

Figure 4:
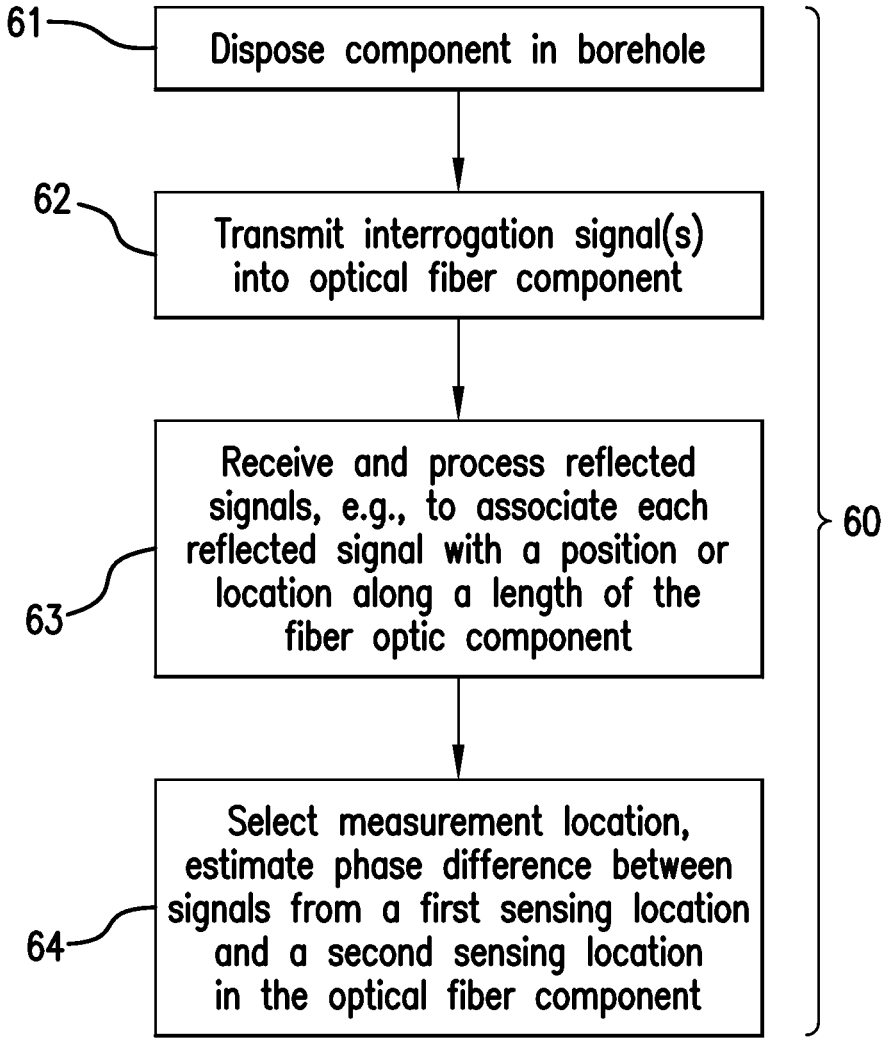
FIG. 4 is a flow chart illustrating a method of monitoring vibration and/or other parameters of a downhole tool.

FIG. 4 illustrates a method 60 of monitoring vibration and/or other parameters of a downhole tool. The method 60 includes one or more of stages 61-64 described herein. The method 60 may be performed continuously or intermittently as desired. The method may be performed by one or more processors or other devices capable of receiving and processing measurement data, such as the surface processing unit 36 and the reflectometer unit 38. In one embodiment, the method includes the execution of all of stages 61-64 in the order described. However, certain stages 61-64 may be omitted, stages may be added, or the order of the stages changed.

In the first stage 61, a component such as the tool 18 and/or the ESP assembly 20 is lowered into the borehole 12. In one embodiment, the ESP motor 22 is started and production fluid is pumped through the ESP assembly 20 and through the production string 14 to a surface location.

In the second stage 62, at least one interrogation signal is transmitted into at least one optical fiber component, e.g., the optical fiber 44, operably connected to the downhole component. In one embodiment, for example as part of an OTDR method, a plurality of coherent interrogation signal pulses are transmitted into the fiber 44.

In the third stage 63, signals reflected from sensing locations 48 in the optical fiber 44 (e.g., reflectors, Bragg gratings and/or Rayleigh scattering locations) are received by the reflectometer unit 38 for each interrogation signal and/or pulse. The reflected signals are processed to correlate the reflected signals to respective sensing locations 48 in the optical fiber 44. In one embodiment, the sensing locations 48 are sections of the optical fiber 44 that intrinsically scatter the interrogation signals and/or pulses. The width of each sensing location 48 may be determined by the width of the pulse. The reflected signals may be processed to generate a scatter pattern illustrating, for example, amplitude and/or phase of a reflected signal over time or distance along the optical fiber 44.

In one embodiment, the reflected signals (e.g., the scatter pattern) are first measured when the optical fiber 44 and/or the downhole component is in an unperturbed or reference state. The scatter pattern is again measured in a perturbed or altered state. An example of a reference state is a measurement of reflected signals taken when a component is not in operation, such as measurement prior to operating the ESP assembly 20. An example of an altered state is a measurement of reflected signals taken when a component is in operation, such as measurement during operating the ESP assembly 20.

In the fourth stage 64, one or more positions (i.e., measurement locations) along the optical fiber 44 are selected and a phase difference between reflected signals from two sensing locations associated with each selected position is estimated. In one embodiment, the reflectometer unit 38 is configured as an interferometer, and the received reflected signals are analyzed by removing common mode paths between a first reflected signal (e.g., a reflected signal from the first scattering location 50) and a second reference signal (e.g., a reflected signal from the second scattering location 52) and extracting a phase differential between the signals. The first and second reflected signals may be selected from, for example, any two sensing locations disposed along the length of the optical fiber 44. For example, the first reflected signal is selected from a sensing location 48 that is located at or proximate to the selected measurement location, and the second reflected signal is selected from any other sensing location disposed in the optical fiber 44 or in an additional optical fiber. In this way, the location for vibration measurements may be dynamically selected and changed as desired. In one embodiment, the reflectometer unit 38 selects one or more of the measurement location pairs 48.

In one embodiment, a plurality of measurement locations are selected along a length of the optical fiber 44, and reflected signal data from sensing locations 48 (i.e., primary sensing locations) at or near each selected measurement location is compared to reflected signal data from one or more reference sensing locations. The reference sensing location may be different for each primary sensing location, or a plurality of primary sensing locations may have a common reference location. A phase difference is then estimated for each primary sensing location and a distributed phase difference pattern is generated that reflects the phase differential along the optical fiber 44. In one embodiment, the selected measurement locations are associated with sensing locations distributed at least substantially continuously along the optical fiber 44, and the phase difference pattern reflects at least substantially continuous phase differential measurements. In one embodiment, a distributed phase difference measurement is generated by dividing the phase difference pattern into bins or sets of phase difference data associated with fiber sections of arbitrary length. This is accomplished, for example, by a boot-strapping approach, in which the phase difference data in each bin is arrived at by removing the phase difference data from previous (i.e., closer to the interrogation signal source) bins.

Phase difference information (e.g., phase difference patterns) may be generated for multiple interrogation signals transmitted periodically over a selected time period. In this way, time-varying distributed phase differential measurements are generated for one or more measurement locations. The time-varying phase differential patterns may be correlated to a vibration of the downhole component (e.g., the ESP motor 22). In addition, selected measurement locations and/or regions of the optical fiber 44 can be dynamically selected and changed at will, e.g., to focus on different areas in the tool 18 and/or the ESP assembly 20.

The phase differential data for each selected position may be generated over a time period. For example, multiple interrogation pulses are transmitted into the optical fiber over a selected time period, and phase differentials at selected positions are estimated for each pulse, to generate a phase differential trace or data set over the time period. This phase differential data set reflects changes in the optical path between selected measurement locations, which can be associated with vibration in the region corresponding to the selected measurement locations. In some embodiments, the measured vibration from 'earlier' in the fiber 44, i.e., from measurement locations associated with other components in the borehole 12, may be subtracted from vibration measurements associated with a selected component or region.

In one embodiment, the first reflected signal and the second reference reflected signal for a selected measurement location are selected from measured reflected signals taken from the optical fiber 44 in an altered state and in an unperturbed (i.e., reference) state, respectively. The phase information from the reference state is subtracted from the altered state phase information to estimate the phase differential for each selected position.

In one embodiment, other parameters associated with the ESP may also be measured. Such parameters include, for example, temperature, strain, pressure, etc. For example, the optical fiber 44 may also include additional sensing components such as Bragg gratings that can be utilized to measure temperature as part of a distributed temperature sensing system.

The systems and methods described herein provide various advantages over prior art techniques. The systems and methods provide a mechanism to measure vibration or other movement or deformation in a distributed manner along a component. In addition, the systems and methods allow for a more precise measurement of vibration at selected locations, as well as allow a user to dynamically change desired measurement locations without the need to reconfigure the monitoring system.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for monitoring a downhole component, the apparatus comprising:

an optical fiber sensor having a length thereof in an operable relationship with the downhole component and configured to deform in response to deformation of the downhole component, the optical fiber sensor including a plurality of scattering locations disposed along a length of the optical fiber sensor;

an interrogation assembly configured as a swept-wavelength interferometry assembly, the interrogation assembly configured to transmit a non-pulsed, continuous swept-wavelength electromagnetic interrogation signal into the optical fiber sensor and receive reflected signals from each of the plurality of intrinsic scattering locations;

a processing unit configured to monitor the downhole component during a downhole operation, receive the reflected signals, select a measurement location along the optical fiber sensor, select a first reflected signal associated with a first intrinsic scattering location in the optical fiber sensor, the first intrinsic scattering location corresponding with the measurement location, select a second reflected signal associated with a second intrinsic scattering location in the optical fiber sensor, perform a Fourier transform on the first reflected signal and the second reflected signal, estimate a phase difference between the first signal and the second signal based on the transformed signals, estimate a parameter of the downhole component at the measurement location based on the phase difference, identify a change in the parameter, and diagnose a potential problem associated with the downhole component based on the change in the parameter.

2. The apparatus of claim 1, wherein the processing unit is further configured to estimate a phase difference for each of the plurality of intrinsic scattering locations and generate a phase difference pattern for the length of the optical fiber sensor.

3. The apparatus of claim 1, wherein the processing unit is further configured to transmit a plurality of interrogation signals into the optical fiber sensor over a time period, estimate a plurality of phase differences between the first signal and the second signal associated with each of the plurality of interrogation signals, and generate a time-varying phase difference pattern.

4. The apparatus of claim 3, wherein the parameter includes a vibration of the downhole component associated with the time-varying phase difference pattern.

5. The apparatus of claim 1, wherein the downhole component includes at least one of a motor and a generator, and the parameter includes a vibration of the motor.

6. The apparatus of claim 5, wherein the interrogation assembly is an optical frequency domain reflectometry (OFDR) assembly, the OFDR assembly configured to apply an optical signal having a wavelength that is continuously swept.

7. The apparatus of claim 5, wherein the processing unit is configured to receive reflected signals from the plurality of intrinsic scattering locations when the downhole component is in a reference state, and subtract phase difference information taken based on the reference state from the phase difference.

8. The apparatus of claim 1, wherein the optical fiber sensor is disposed in a fixed relationship relative to the downhole component.

9. The apparatus of claim 1, wherein the parameter includes at least one of a movement, a strain and a deformation of the downhole component.

10. The apparatus of claim 1, wherein the processing unit is configured to select the first reflected signal and the second reflected signal based on the measurement location without previous knowledge of the first intrinsic scattering location and the second intrinsic scattering location.

11. The apparatus of claim 1, wherein the reflected signals include at least one of Rayleigh scattering signals, Brillouin scattering signals and Raman scattering signals.

12. A method of monitoring a downhole component, the method comprising:

disposing a length of an optical fiber sensor in a fixed relationship relative to a downhole component, the optical fiber sensor configured to deform in response to deformation of the downhole component, the optical fiber sensor including a plurality of scattering locations disposed along a length of the optical fiber sensor;

transmitting a non-pulsed, continuous swept-wavelength electromagnetic interrogation signal into the optical fiber sensor by a swept-wavelength interferometry assembly, and receiving reflected signals from each of the plurality of intrinsic scattering locations;

selecting a measurement location along the optical fiber sensor;

selecting a first reflected signal associated with a first intrinsic scattering location in the optical fiber sensor, the first intrinsic scattering location corresponding with the measurement location;

selecting a second reflected signal associated with a second intrinsic scattering location in the optical fiber sensor;

performing by a processor a Fourier transform on the first reflected signal and the second reflected signal and estimating by the processor a phase difference between the first signal and the second signal based on the transformed signals; and estimating a parameter of the downhole component at the measurement location based on the phase difference;

identifying a change in the parameter; and diagnosing a potential problem associated with the downhole component based on the change in the parameter.

13. The method of claim 12, further comprising estimating a phase difference for each of the plurality of intrinsic scattering locations and generating a phase difference pattern for the length of the optical fiber sensor.

14. The method of claim 12, further comprising transmitting a plurality of interrogation signals into the optical fiber sensor over a time period, estimating a plurality of phase differences between the first signal and the second signal associated with each of the plurality of interrogation signals, and generating a time-varying phase difference pattern.

15. The method of claim 14, wherein the parameter includes a vibration of the downhole component associated with the time-varying phase difference pattern.

16. The method of claim 12, wherein the downhole component includes at least one of a motor and a generator and the parameter includes a vibration.

17. The method of claim 12, wherein the parameter includes at least one of a movement, a strain and a deformation of the downhole component.

18. The method of claim 12, wherein the first reflected signal and the second reflected signal are selected based on the measurement location without previous knowledge of the first intrinsic scattering location and the second intrinsic scattering location.

19. The method of claim 18, wherein the interrogation assembly is an optical frequency domain reflectometry (OFDR) assembly.

20. The method of claim 12, further comprising receiving reflected signals from the plurality of intrinsic scattering locations when the downhole component is in a reference state, and subtracting phase difference information taken based on the reference state from the phase difference.

* * * * *